US006109069A

United States Patent [19]

Sangiacomo

[11] Patent Number: 6,109,069

[45] Date of Patent: Aug. 29, 2000

[54] YARN GUIDE UNIT ESPECIALLY FOR CIRCULAR DOUBLE CYLINDER HOSIERY MACHINES

[75] Inventor: Fulvio Sangiacomo, Brescia, Italy

[73] Assignee: Sangiacomo S.p.A., Brescia, Italy

[21] Appl. No.: 09/421,587

[22] Filed: Oct. 20, 1999

[30] Foreign Application Priority Data

Oct. 30, 1998 [IT] Italy ..... BS/98/A/0078

[51] Int. Cl.[7] ..... D04B 15/58

[52] U.S. Cl. ..... 66/133; 66/18

[58] Field of Search ..... 66/8, 13, 14, 17, 66/18, 125 R, 131, 133, 136, 146, 125 B

[56] References Cited

U.S. PATENT DOCUMENTS 2,399,729 5/1946 Fregeolle ..... 66/133
5,056,339 10/1991 Lonati ..... 66/133
5,239,845 8/1993 Luchi ..... 66/133
5,524,459 6/1996 Beconcini ..... 66/133

FOREIGN PATENT DOCUMENTS 2256441 12/1992 United Kingdom ..... 66/133

*Primary Examiner*—Danny Worrell
*Attorney, Agent, or Firm*—McGlew and Tuttle, P.C.

[57] ABSTRACT

The invention relates to a yarn guide unit particularly for circular double cylinder hosiery machines in which a yarn guide rod is borne on a block (16) eccentrically pivoted on a rotating disk (18) which can move between two extreme angular positions corresponding to the engaged working and disengaged positions of the yarn guides. Rotation of the disk with the block is brought about in one direction by a pneumatic actuator (28) incorporated in the block (16) and in the opposite direction by a return spring attached to the disk.

8 Claims, 3 Drawing Sheets

YARN GUIDE UNIT ESPECIALLY FOR CIRCULAR DOUBLE CYLINDER HOSIERY MACHINES

FIELD OF THE INVENTION

This invention relates to the art of circular machines for knitting and hosiery and relates more particularly to a yarn guide unit for delivering yarn to the needles of circular double cylinder hosiery machines.

BACKGROUND OF THE INVENTION

Various yarn feed units which comprise yarn guides corresponding to each feed station in the machine are already known and in use in circular hosiery machines, including double cylinder machines. The yarn guides are controlled and moved individually between an engaged position close to the cylinder, to deliver yarn to the corresponding needles, and a disengaged position, away from the cylinder, to prevent yarn from being picked up by the needles. This is so that the needles can be fed with yarns of different nature, weight and colour from time to time on the basis of the requirements of the current knitting work. At the present time yarn guides are engaged and disengaged by various means, well known to those skilled in the art, but which are nevertheless relatively complex and cumbersome, given the nature and arrangement of the components of such actuator means.

SUMMARY AND OBJECTIVES OF THE INVENTION

The purpose of this invention on the other hand is to simplify the structure of the yarn guides and to improve changing of the yarn guides while knitting, especially on circular hosiery machines, particularly when knitting mixed cotton yarn and the like.

A further purpose of the invention is to provide each yarn guide with an original control system which offers a better distribution of the forces bringing about the engaging and disengaging movements of the yarn guide, to reduce velocity and ensure smoothness of movement, ensuring greater accuracy when the yarn guide engages the predetermined sector of needles, and avoiding jerking the yarn so as not to place undue stress on the flattened parts of the needles when the yarn guide disengages.

These purposes, and others which have not yet been mentioned, are accomplished by means of an improved yarn guide particularly for double cylinder circular hosiery machines with a base plate and a rotating disc mounted rotatably on the base plate between first and second angular positions. A block is pivotal eccentrically on the rotating disc and a yarn guide rod is mounted on the block. The yarn guide rod has a free end defining a hole for passage and guidance of yarn. A control means rotates the disc between first and second angular positions with the block and rod following the rotation of the disc. The block and rod at the same time make angular movements relative to the rotating disc to carry the yarn guide from an extreme disengaged position to an extreme engaged position. The extreme disengaged position is away from the needles of the knitting machine, and the extreme engaged position are adjacent the needles. The control means is arranged on the block and the rotating disc.

The innovative and advantageous aspects of the invention can be identified as at least

- pneumatic control of the yarn guide incorporated with the support for the yarn guide itself without substantially affecting overall dimensions,

- simplicity of construction of the component parts and adjustment of the yarn guide on the circular machine,
- the number of components subject to wear, and therefore reduced maintenance costs,
- single pneumatic control sufficient to position the yarn guide in the engaged and disengaged or resting positions,
- reduced consumption of compressed air, given that only one pneumatic control is present,
- the possibility of additional travel to optimise pick-up of the yarn through movement of the entire yarn guide unit.

BRIEF DESCRIPTION OF THE DRAWINGS

Further details of the invention will be described below with reference to the appended indicative and non-restrictive drawings in which.

DESCRIPTION OF THE PREFERRED EMBODIMENTS

Figure 1:
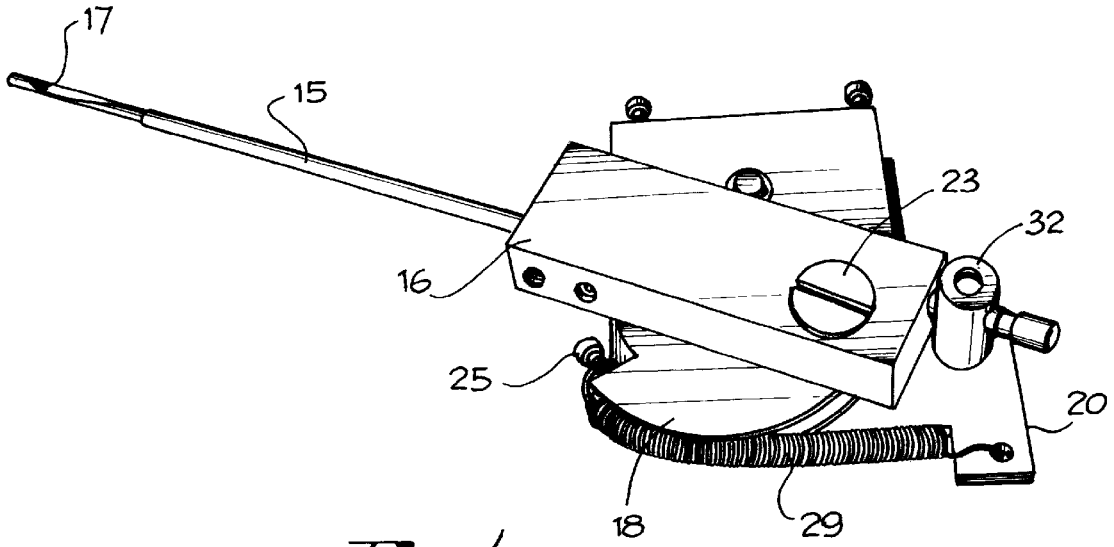
FIGS. 1 and 2 show a yarn guide unit in perspective view from two different angles.
Figure 2:
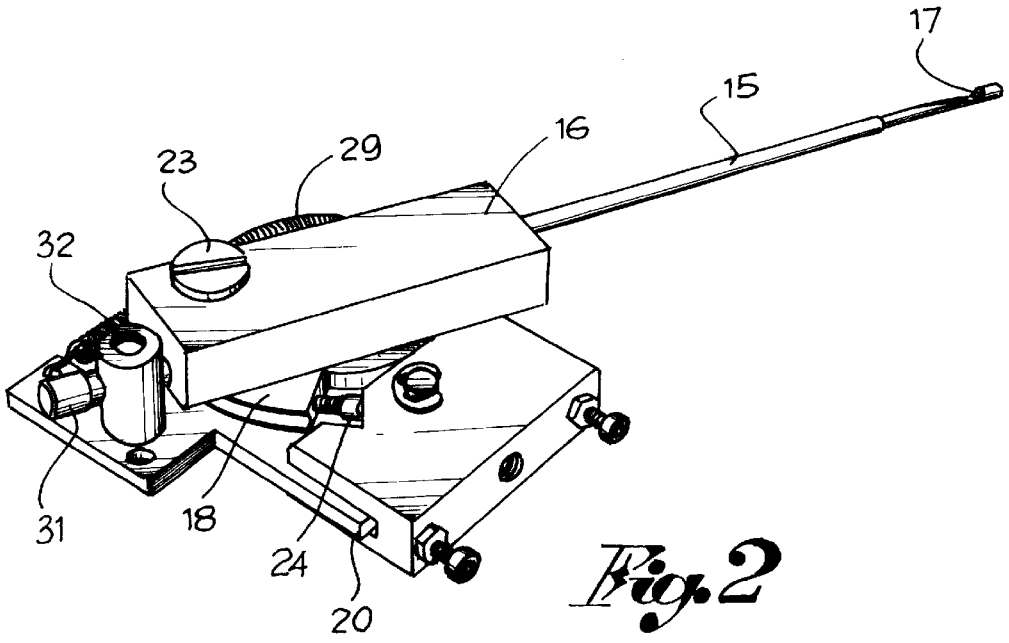

Yarn guide unit 10 proposed here applies particularly to a circular machine for double cylinder hosiery, of which cylinder 11, needle 12, plate 13 and, alongside the cylinder, a unit 14 for yarn cutting and picking when the yarn is not being worked are illustrated indicatively in the drawings.

Yarn guide unit 10 comprises a rod 15 which extends from a block 16 to which it is fixed and which at its free end has at least one hole 17 for the passage and guidance of a yarn—not shown—which is to be delivered to the needles 12 of the circular machine.

Figure 4:
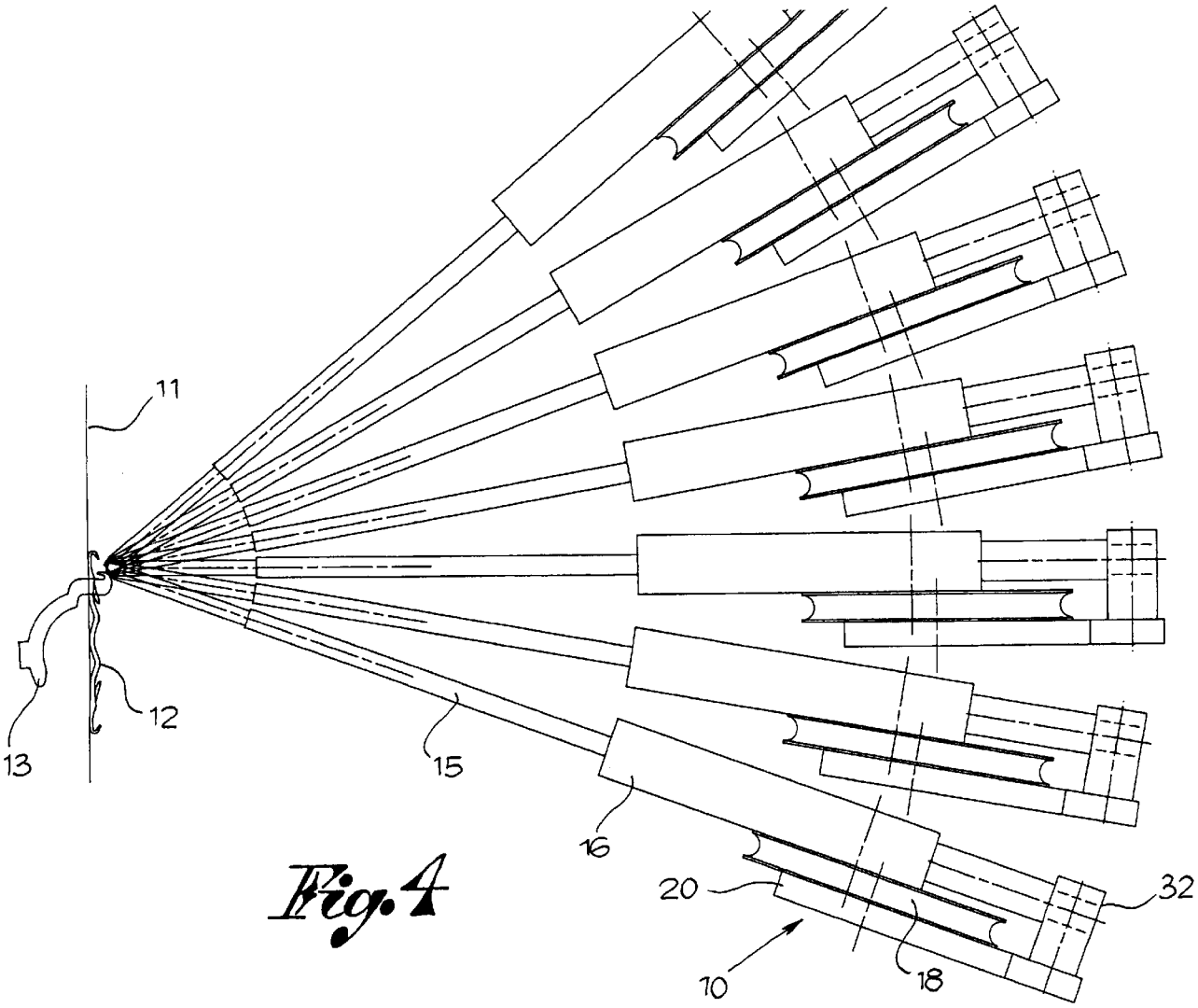
FIG. 4 shows in diagrammatical form a plurality of yarn guides in a feed station of a double cylinder circular machine.

Block 16 is mounted on a disk 18 which is rotatably mounted about a shaft 19 on a base plate 20. This base plate 20 is in turn fixed to a support 21 by means of which yarn guide 10 is positioned and fixed to part of the body 22 of the circular machine together with a plurality of other yarn guides, FIG. 4, with the rod 15 of each yarn guide facing cylinder 11 where the needles are to be fed.

More specifically, block 16 is eccentrically pivoted on disk 18 by means of a pin 23 and is capable of making angular movements about said pin 23 while at the same time following the rotation of disk 18. The latter can rotate alternately through a specific angle between two extreme positions A, B defined by adjustable stop screws 24, 25 located on the edge of the disk and designed to bear against fixed bearing surfaces 26, 27 respectively on base plate 20.

Disengagement corresponds to one extreme position A of block 16 with yarn guide rod 15, while the other extreme position B of block 16 corresponds to engagement for the delivery of yarn to the needles.

The alternating rotation of disk 18 and, in combination, of block 16 with yarn guide rod 15 from one position to the other is brought about in the outward direction by a single-action pneumatic actuating piston 28 and on the return by a return spring 29. Pneumatic piston 28 pushes block 16 and causes disk 18 to rotate from disengaged position A to engaged position B; return spring 29 brings disk 18 back and with it block 16 from position A to disengaged position B.

Figure 3:
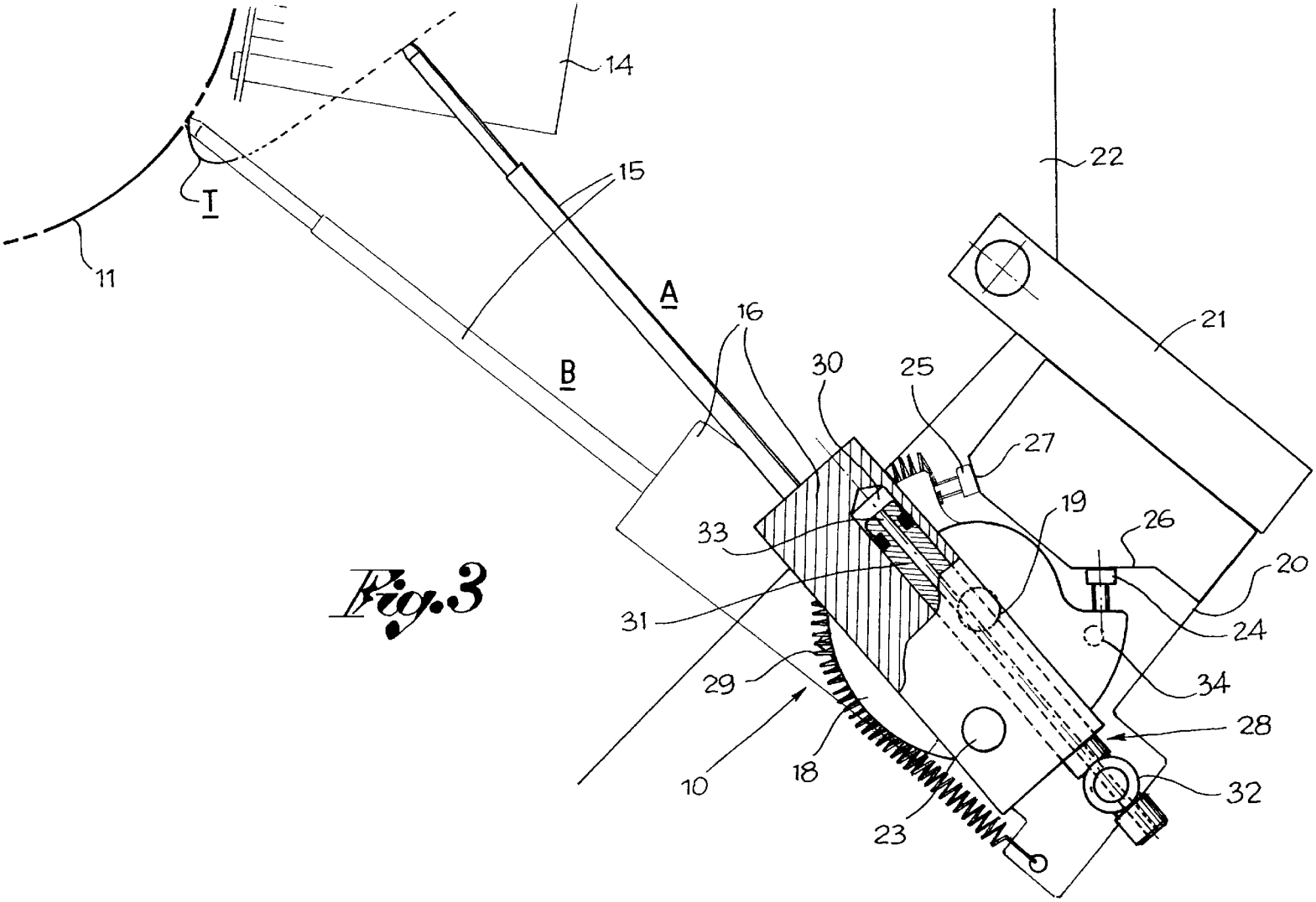
FIG. 3 shows a yarn guide in plan and partial cross-section where the bolder lines show the yarn guide in a disengaged withdrawn position and the lighter lines show the yarn guide in an engaged position.

In the simplified embodiment in FIG. 3 actuator piston 28 is incorporated with block 16. This further incorporates a cylindrical chamber 30 made in block 16 and a piston 31 housed in the said chamber. Piston 31 is anchored on its shank side to a shaft 32, parallel with the axis of rotation of disk 18 and rotatably mounted on base plate 20. Delivery of pneumatic fluid to chamber 30 by the actuator piston control is brought about through a longitudinal hole 33 made in piston 31 from the end of its shank anchored to shaft 32.

Return spring 29 has one end attached to the periphery of rotating disk 18 and the other end anchored to base plate 20.

In the assembly described above, piston 31 is axially fixed and can only rotate with shaft 32 to which it is anchored. Thus the delivery of pressurised pneumatic fluid to chamber 30 causes block 16 to move axially relative to the piston at the same time bringing about rotation of the disk as in a crank and connecting rod system. Then the combined movements of block 16 and disk 18 from disengaged position A to engaged position B causes the end of yarn guide rod 15 to follow a special parabolic trajectory T, as shown in FIG. 3, to carry the yarn to a correct radial position alongside the needles which have to be supplied with yarn. Furthermore, block 16 can be engaged from the outer side by second control means—not shown—so that the end of yarn guide rod 15 performs a small amount of additional outward travel and a subsequent slow return, which helps to improve yarn pick-up by the needles, pick-up which may be assisted by a blast of air or other elements.

When the pneumatic fluid is cut off from chamber 30, rotating disk 18 returns to the initial position through the effect of return spring 29 returning block 16, and with it yarn guide rod 15, to the disengaged or resting position.

All this with minimum dimensions and to assist the application of a plurality of yarn guides at each feed station in the circular machine in question with the possibility of selectively engaging each yarn guide individually or several yarn guides simultaneously with the freedom to perform any knitting operation. In addition to this, each yarn guide can be mounted with play or elastically, or the rod may be flexible, so that small movements can be made with the effect that the yarn guides, although possibly touching at the tip, do not obstruct each other when they engage and disengage.

Finally it should be noted that additional stop means 34 of a pneumatic or other nature, which can be retracted as necessary, are provided on the base plate of the yarn guide unit to stop disk 18 and thereby block 16 with yarn guide rod 15 in an intermediate position between extreme positions A, B to detach the rod from the cylinder without moving it away completely, leaving room for another yarn guide rod.

What is claimed is:

1. Yarn guide unit for a circular knitting machine characterized by:

a base plate which is fixed to the machine, a rotating disk mounted on said base plate and rotating alternately between two extreme angular positions (A, B), a block pivoted eccentrically on said rotating disk and bearing a yarn guide rod which at its free end has at least one hole for passage and guidance of at least one yarn, control means to cause said disk to rotate between said extreme positions, said block and said rod following the rotation of said disk and at the same time being capable of making angular movements relative to the rotating disk to carry said rod from an extreme disengaged position (A) away from the needles of the knitting machine to the other extreme engaged position (B) alongside the needles which have to be supplied with yarn, and said control means being on board said block and said rotating disk.

2. Yarn guide unit according to claim 1, in which the disk is mounted on the base plate with an axis of rotation perpendicular to the plane in which the yarn guide rod moves in order to engage and disengage, and the block is eccentrically pivoted on said disk and is capable of angular movements about a shaft parallel to the axis of the rotating disk.

3. Yarn guide unit according to claim 1, in which said control means comprise a pneumatic activator piston incorporated in the block bearing the yarn guide rod and a return spring connected at one end to the rotating disk and at the other to the base plate, the pneumatic actuator being designed to move the block and the rotating disk from the disengaged position (A) to the engaged working position (B), and the return spring in the opposite direction.

4. Yarn guide unit according to claim 3, in which said pneumatic actuator piston comprises a cylindrical chamber, a piston housed in said chamber and anchored by its shank to said shaft about which the block moves angularly, and a hole delivering pneumatic fluid to said chamber to move the block on and relative to the piston.

5. Yarn guide unit according to claim 1 in which the rotating disk bears adjustment screws designed to interact with fixed bearing surfaces on the base plate to determine the extreme positions (A, B) of rotation of the said disk.

6. Yarn guide unit according to claim 5, in which additional retractable stop means are provided on the base plate to selectively stop the rotating disk and through this the yarn guide rod in an intermediate position between the two extreme positions (A, B).

7. Yarn guide unit according to claim 2, in which said control means comprise a pneumatic activator piston incorporated in the block bearing the yarn guide rod and a return spring connected at one end to the rotating disk and at the other to the base plate, the pneumatic actuator being designed to move the block and the rotating disk from the disengaged position (A) to the engaged working position (B), and the return spring in the opposite direction.

8. A yarn guide unit for a knitting machine, the yarn guide unit comprising:

a base plate;

a rotating disk mounted on said base plate and rotatable alternately between first and second angular positions;

a block pivotal eccentrically on said rotating disk;

a yarn guide rod mounted on said block, said yarn guide rod having a free end defining a hole for passage and guidance of yarn;

control means for rotating said disk between said first and second angular positions with said block and said rod following rotation of said disk and at a same time making angular movements relative to said rotating disk to carry said yarn guide rod from an extreme disengaged position away from needles of the knitting machine to another extreme engaged position adjacent the needles, said control means arranged on said block and said rotating disk.

* * * * *